US006552700B2

(12) United States Patent
Narui

(10) Patent No.: US 6,552,700 B2
(45) Date of Patent: Apr. 22, 2003

(54) MONITOR ADJUSTMENT BY DATA MANIPULATION

(75) Inventor: Yoshihisa Narui, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/044,900

(22) Filed: Jan. 9, 2002

(65) Prior Publication Data

US 2002/0113780 A1 Aug. 22, 2002

Related U.S. Application Data

(63) Continuation of application No. 09/441,117, filed on Nov. 17, 1999, now Pat. No. 6,411,267.

(51) Int. Cl.[7] ..... G09G 1/06
(52) U.S. Cl. ..... 345/10; 345/213
(58) Field of Search ..... 345/10, 13, 14, 345/27, 28, 29, 99, 213, 15; 315/371, 368; 348/177, 178, 180, 181, 184, 185, 460, 511, 555

(56) References Cited

U.S. PATENT DOCUMENTS

| | | | | |
|---|---|---|---|---|
| 4,633,313 A | | 12/1986 | Mogi et al. | |
| 4,789,856 A | | 12/1988 | Yokota et al. | |
| 5,636,312 A | | 6/1997 | Okamoto et al. | |
| 5,812,210 A | | 9/1998 | Arai et al. | |
| 6,124,685 A | * | 9/2000 | Toriu et al. | 315/369 |
| 6,195,077 B1 | | 2/2001 | Gyouten et al. | |
| 6,339,412 B1 | * | 1/2002 | Lee | 327/2 |

* cited by examiner

*Primary Examiner*—Chanh Nguyen
(74) *Attorney, Agent, or Firm*—Fitch, Even, Tabin, & Flannery

(57) ABSTRACT

A monitor, preferably a CRT, comprising a display screen for displaying an image, a frame memory for storing one or more frames of video display data for display by the display screen, and a clock control circuit for dynamically varying either or both of the timing and interval spacing of a data output clock used to read out the display data from the frame memory to the display screen in order to manipulate the image displayed on the display screen.

24 Claims, 5 Drawing Sheets

Output Clock Control

Frame Data

Output Clock

Normal

Output Image

Output Clock

Center Control

Output Clock

Size Control

MONITOR ADJUSTMENT BY DATA MANIPULATION

This is a continuation of U.S. patent application Ser. No. 09/441,117, filed Nov. 17, 1999, for MONITOR ADJUSTMENT BY DATA MANIPULATION, by Narui, now U.S. Pat. No. 6,411,267.

BACKGROUND OF THE INVENTION

This invention pertains to a monitor, preferably a cathode ray tube (CRT) monitor and, more particularly, to a CRT monitor that provides a means for image manipulation.

Conventional monitor, for example CRT monitors, have some geometry distortion dependent upon the input display signals and magnetic fields in the vicinity of the monitor. Conventional monitor have an adjustment function using modulation circuits and coils. Such an arrangement is expensive in that it incurs additional hardware and manufacturing costs.

What is needed is a convenient and efficient way to adjust for image distortion in a monitor.

SUMMARY OF THE INVENTION

The above and other objectives are achieved by monitor, preferably a CRT monitor, according to the present invention that includes a display screen for displaying an image, a frame memory for storing one or more frames of video display data for display by the display screen, and a clock control means for varying the timing at which the display data are read out from the frame memory to the display screen to manipulate the image displayed on the display screen.

In the preferred embodiment, the display screen includes a horizontal scanning frequency signal generator that generates a horizontal scanning signal including a horizontal sync signal and the clock control means produces a clock signal corresponding to a predetermined multiple of the horizontal scanning frequency. The clock signal has a variable delay with respect to the horizontal sync signal. The variable delay can be before the horizontal sync signal, after the horizontal sync signal, or both. Alternatively, or in addition the clock control means dynamically adjusts the periods between clock signal pulses. Further, the periods between clock pulses at the beginning of a horizontal display line on the display screen can be longer than the periods between the clock pulses at the end of the horizontal display line on the display screen or, alternatively, the periods between clock pulses in the middle of a horizontal display line on the display screen are shorter than the periods between the clock pulses at the beginning and end of the horizontal display line on the display screen.

The invention also includes a method for manipulating an image displayed on a monitor, preferably a CRT monitor, comprising the steps of displaying an image on a display screen, storing one or more frames of video display data for display by the display screen in a frame memory, and varying the timing at which the display data are read out from the frame memory to the display screen to manipulate the image displayed on the display screen. The method of the preferred embodiment further includes the steps of generating a horizontal scanning signal including a horizontal sync signal and producing a clock signal corresponding to a predetermined multiple of the horizontal scanning frequency. The clock signal has a variable delay with respect to the horizontal sync signal and/or a variable delay both before the horizontal sync signal and after the horizontal sync signal. Additionally or alternatively, the periods between clock signal pulses are dynamically adjusted. This includes making the periods between clock pulses at the beginning of a horizontal display line on the display screen longer than the periods between the clock pulses at the end of the horizontal display line on the display screen or making the periods between clock pulses in the middle of a horizontal display line on the display screen shorter than the periods between the clock pulses at the beginning and end of the horizontal display line on the display screen.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
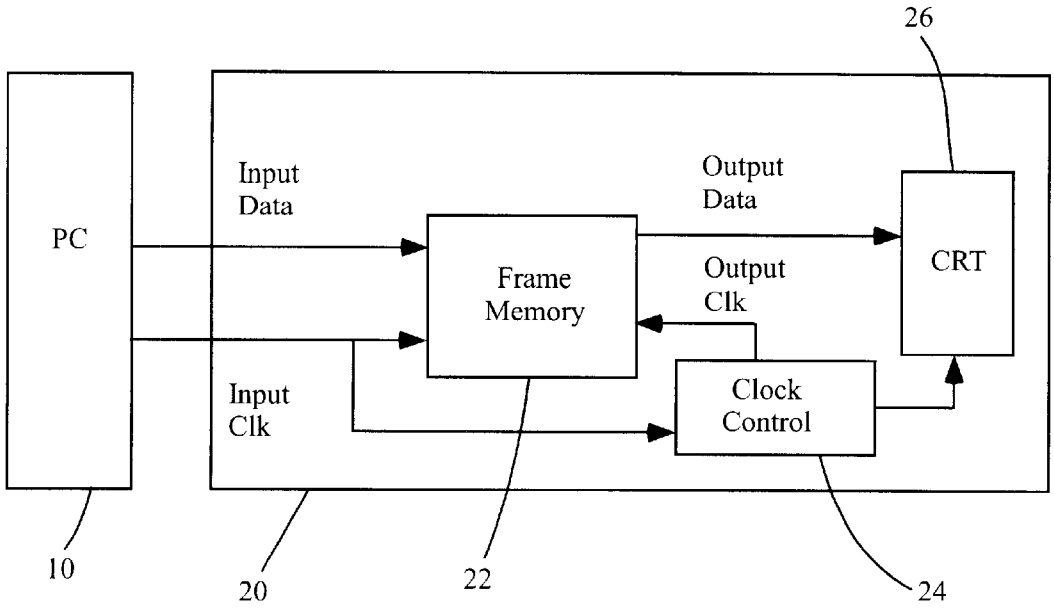
FIG. 1 is a block diagram of a first embodiment of the invention.

Referring now more particularly to FIG. 1, a block diagram of the apparatus of the present invention is shown. A personal computer (PC) 10 outputs video display signals (Input Data). These could be either in digital or analog form. The display signals are received by a monitor 20 connected to the PC 10. If the display signals are in analog form, they are converted to digital display signals by an analog to digital (A/D) converter (not shown) within the monitor 20. Also output by the PC 10 to the monitor 20 is an input clock (Input CLK) signal.

Within the monitor 20, the display data signal (Input Data) and the clock (Input CLK) are input to a frame memory 22. The display data are written to the frame memory at the timing of Input CLK. A clock control circuit 24 generates an output clock (Output CLK) or data output clock and supplies the Output CLK to the frame memory 22 to read out the stored display data (Output Data) at a rate determined by the Output CLK. The Output Data are supplied to a display, preferably a CRT 26.

Figure 2A:
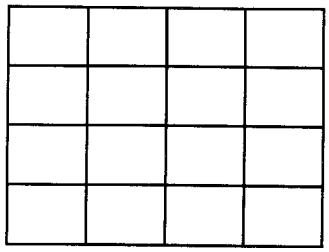
FIGS. 2A, 2B and 2C are diagrams for use in explaining the operation of the invention and represent, respectively, an undistorted display of the input display data, a normal data output clock wave form, and an undistorted display by the monitor of the input display data.
Figure 2B:
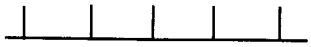
Figure 2C:
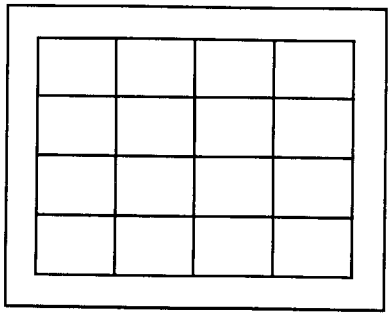

As mentioned above, conventional display screens may have inherent distortion due to magnetic fields and the like. Referring now to FIGS. 2A, 2B and 2C, if the display data stored in the frame memory 22 has a pattern of identical rectangles, as represented by the pattern shown in FIG. 2A, and the Output CLK has a regular spacing of data output clocks in reading out the display data, that is, if the data output clocks are spaced at regular intervals relative to a vertical sync signal and a horizontal sync signal of the display screen 26, then the same pattern of identical rectangles should be displayed by the display screen 26, as shown in FIG. 2C.

Figure 3A:
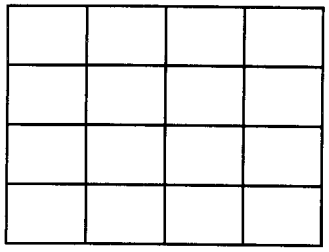
FIGS. 3A, 3B and 3C are diagrams for use in explaining the operation of the invention and represent, respectively, an undistorted display of the input display data, a data output clock wave form the timing of which is shifted to compensate for centering of the output display, and a display of the input display data by the monitor using the data output clock timing signal of FIG. 3B.
Figure 3B:
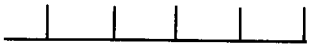
Figure 3C:
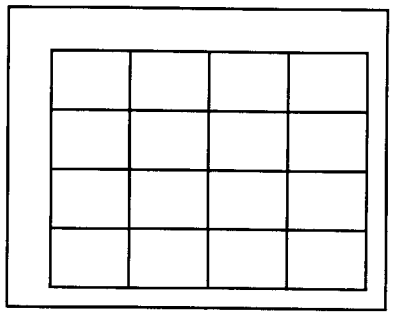

However, if the display screen 26 has a tendency to distort the display by shifting the pattern to the upper left, then it is necessary to pre-shift the display in the opposite direction, as shown in FIG. 3C, to compensate. To do this, the clock control 24 controls the timing of the data output clocks Output CLK so that display data are read out from the frame memory 22 later with respect to the vertical sync signal and the horizontal sync signal of the display screen 26 as compared to the display of FIG. 2C. As shown in FIG. 3B, the data output clocks are shifted to the right as viewed in the figure compared to the data output clock timing in FIG. 2B. Note that this type of data output clock control is effectively a display centering control.

Figure 4A:
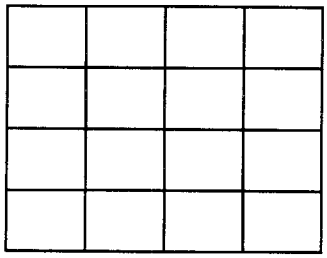
FIGS. 4A, 4B and 4C are diagrams for use in explaining the operation of the invention and represent, respectively, an undistorted display of the input display data, a data output clock wave form wherein the intervals between the data output clock pulses have been shortened from the wave form in FIG. 2B and they are shifted in timing toward the center of the horizontal scan line from the beginning and ending of the horizontal scan line, and a display of the input display data by the monitor using the data output clock wave form of FIG. 4B.
Figure 4B:
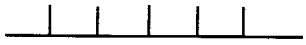
Figure 4C:
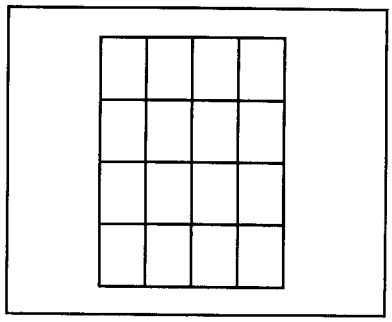

Similarly, if the display screen 26 distorts the display by skewing the display horizontally or vertically, then it becomes necessary to change the data output clock interval spacing and timing to compensate. Assume, for example, that it is necessary to compress the display horizontally to compensate for an expansive horizontal distortion. In this case, as shown in FIG. 4B, the clock control 24 produces Output CLK signals that, with respect to the horizontal sync signal of the display screen 26, begin later and end earlier than in the pattern of FIG. 2B. This produces a display as shown in FIG. 4C that is compressed horizontally. A similar adjustment can be made in the vertical direction by adjusting the timing of the data output clocks, with respect to the vertical sync of the display screen 26 so that data output clocks begin later and end earlier. Combining both of these data output clock timing patterns allows for adjustment of the size of the display on the display screen 26.

Figure 5A:
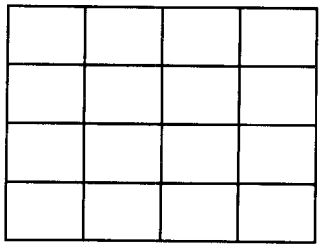
FIGS. 5A, 5B and 5C are diagrams for use in explaining the operation of the invention and represent, respectively, an undistorted display of the input display data, a data output clock wave form wherein the intervals between the data output clocks at the end of the horizontal scan line have been shortened relative to the intervals between the remaining data output clocks of the horizontal scan line, and a display of the input display data by the monitor using the data output clock wave form of FIG. 5B.
Figure 5B:
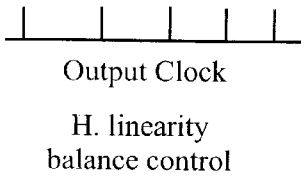
Figure 5C:
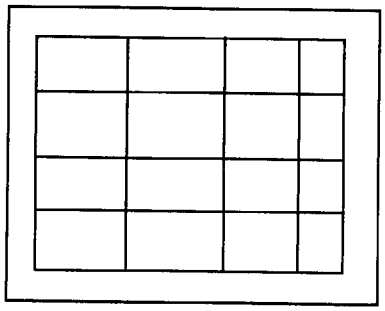

Referring now more particularly to FIGS. 5A, 5B and 5C, in some cases it is necessary to control the horizontal linearity balance of the display. In this situation, the clock control 24 adjusts the data output clock interval spacing within each horizontal scan line. For example, if the intervals between the data output clocks toward the end of the horizontal scan line are made shorter than the data output clock intervals over the remainder of the horizontal scan line, than the display shown in FIG. 5C results, that is the image is skewed to the right in the figure. By controlling the data output clock interval spacing to be irregular toward either end of the horizontal scan line, the horizontal linearity balance in the display can be controlled.

Figure 6A:
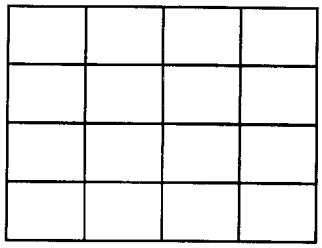
FIGS. 6A, 6B and 6C are diagrams for use in explaining the operation of the invention and represent, respectively, an undistorted display of the input display data, a data output clock wave form wherein the intervals between the data output clocks in the center of the horizontal scan line have been shortened relative to the interval after the beginning data output clock and before the ending data output clock of the horizontal scan line, and a display of the input display data by the monitor using the data output clock wave form of FIG. 6B.
Figure 6B:
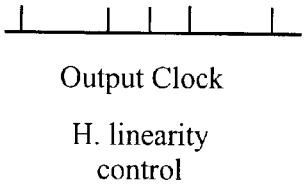
Figure 6C:
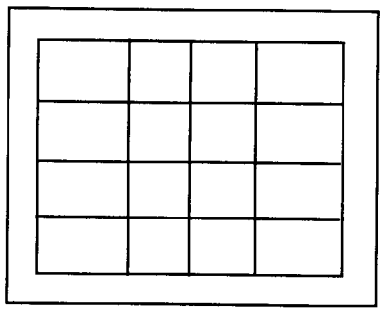

Similarly, when it is necessary to control the horizontal linearity, the intervals between the data output clocks output from the clock control 24 are made closer together in the middle of the horizontal scan line, as shown in FIG. 6B, to produce an output display as shown in FIG. 6C on the display screen 26.

While certain types of effects obtainable utilizing the present invention have been described above, they are not to be construed as limiting of the scope of the invention. By similar manipulations of the timing and interval spacing of the data output clock relative to horizontal sync and vertical sync signals of the display screen 26, the following display effects can be achieved: size changes, centering, pincushion, pincushion balance, keystone, keystone balance, tilt, vertical linearity, vertical linearity balance, vertical pin cushion, vertical pincushion balance, vertical keystone, vertical keystone balance, contrast, brightness, corner brightness, gamma, and convergence. Furthermore, image deformation functions such as zoom, image flip, and image rotation can be performed.

Figure 7:
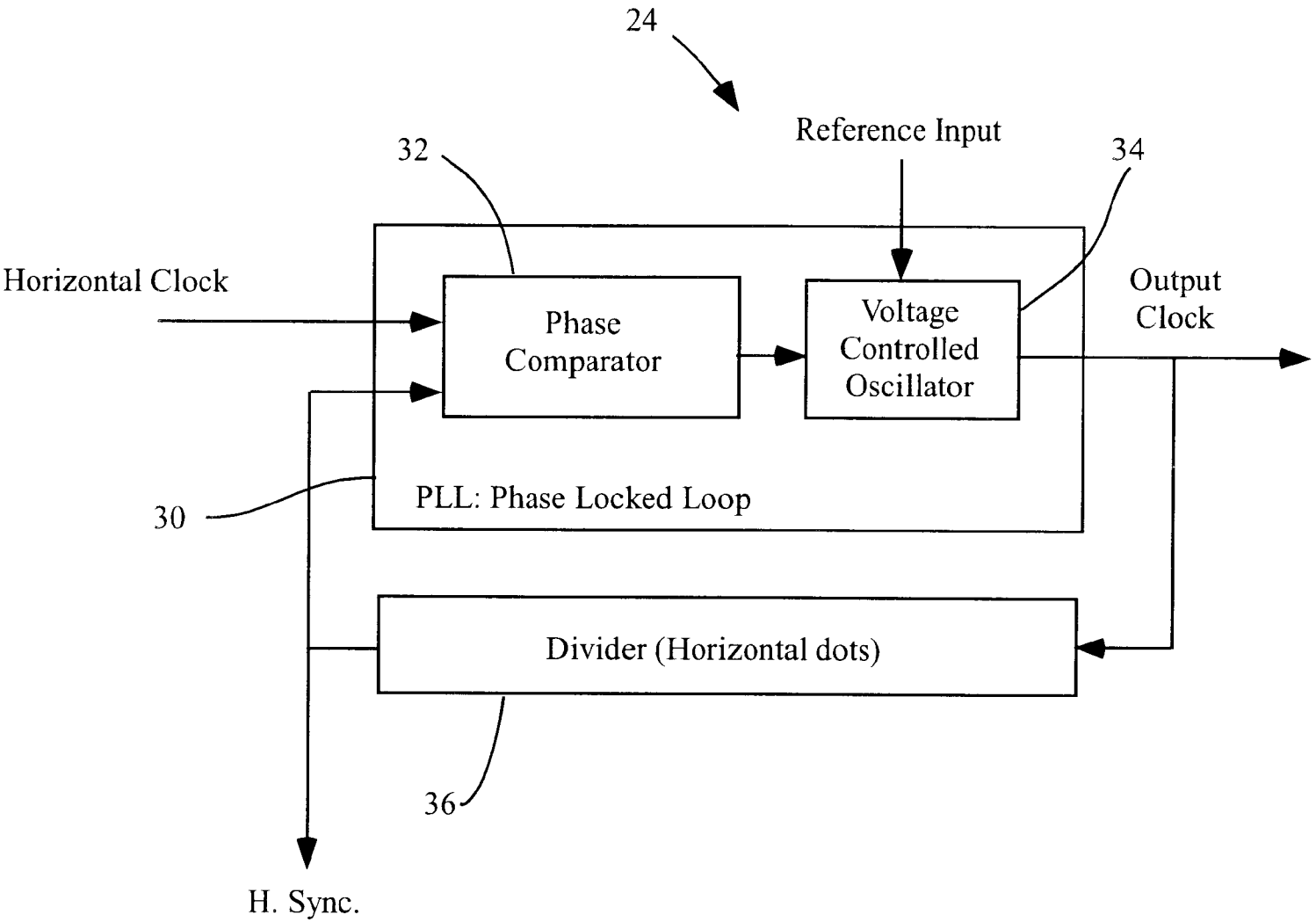
FIG. 7 is a more detailed diagram of the clock control block of the embodiment of FIG. 1.

Referring now to FIG. 7, the details of the clock control unit 24 are shown. A horizontal clock signal from the PC 10 is input to one input of a phase locked loop (PLL) circuit 30. More specifically, the horizontal clock signal is input to one input of a phase comparator circuit 32. Another input to the phase comparator circuit 32 is an output of a frequency divider circuit 36. Although not shown, the phase comparator 32 may include a low pass filter. The output of the phase comparator 32 represents the difference between the phases of the two input signals to the phase comparator 32. The output of the phase comparator 32 is supplied as one controlling input to a voltage controlled oscillator (VCO) 34 that outputs the output clock signal (Output CLK) and also to the input of the frequency divider 36. Although not shown, the output of the frequency divider 36 is also supplied as the horizontal sync signal to the display screen 26.

In operation, the output of the VCO 34 is frequency divided by the frequency divider 36 to output a pulse once per horizontal scan line (after counting the number of clock pulses corresponding to the horizontal resolution). The phase of this output pulse from the frequency divider 36 is compared by the phase comparator 32 with the phase of the horizontal clock from the PC. The phase difference is supplied to the VCO 34 in a manner to cause the VCO to change its frequency to try to adjust the phase difference to zero.

Figures 8A, 8B, 8C, 8D:
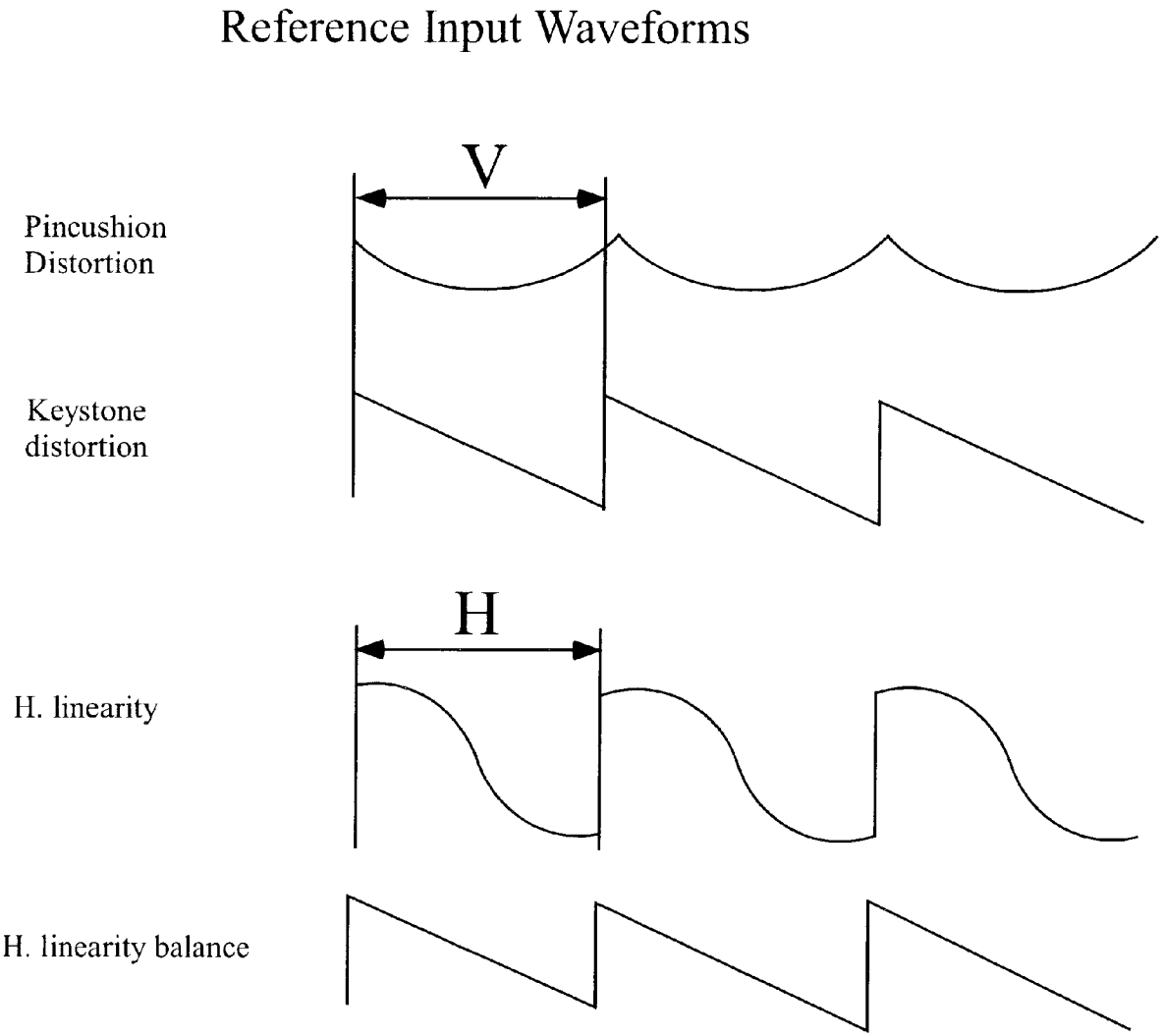
FIGS. 8A, 8B and 8C are waveform diagrams for use in explaining the reference input signal to the clock control FIG. 8 block depicted in FIG. 7.

A second input to the VCO 34 is a reference input. Referring now to FIG. 8, various reference input waveforms are depicted. To achieve the pincushion distortion effect, the reference input should have the waveform shown in FIG. 8A, where the period of the waveform coincides with the vertical sync signal of the CRT 26. Similarly, to achieve the keystone distortion effect, the reference input should have the waveform shown in FIG. 8B, where the period of the waveform coincides with the vertical sync signal of the CRT 26. To achieve horizontal linearity control (see FIGS. 6B and 6C), the reference input should have the waveform shown in FIG. 8C, where the period of the waveform coincides with the horizontal sync signal of the CRT 26. To achieve horizontal linearity balance control (see FIGS. 5B and 5C), the reference input should have the waveform shown in FIG. 8D, where the period of the waveform coincides with the horizontal sync signal of the CRT 26.

Although the present invention has been shown and described with respect to preferred embodiments, various changes and modifications are deemed to lie within the spirit and scope of the invention as claimed. The corresponding structures, materials, acts, and equivalents of all means or step plus function elements in the claims which follow are intended to include any structure, material, or acts for performing the functions in combination with other claimed elements as specifically claimed.

What is claimed is:

1. A monitor comprising:

a display screen for displaying an image;

a frame memory for storing one or more frames of display data for display by the display screen;

an output clock configured to provide timing for reading display data from the frame memory; and an output clock control means for varying the timing of the output clock according to a reference waveform applied to the output clock, wherein the varying the timing of the output clock comprises the steps of:

(a) generating output clock pulses for reading display data out of the frame memory, the timing and frequency of the output clock pulses being a function of two separate input signals;

(b) frequency dividing the output clock pulses and producing an output horizontal sync pulse every predetermined number of clock pulses;

(c) phase comparing both an input horizontal clock signal from an external source that also supplies the display data to the frame memory and the output horizontal sync pulse to produce a phase error signal representing the difference in phase between the output horizontal sync pulse and the horizontal clock signal and supplying the phase error signal as a first one of the two separate input signals for step (a); and applying a reference signal as a second one of the two separate input signals for step (a) for varying the period and timing of the clock pulses as a function of the waveform of the reference signal.

2. The monitor according to claim 1, wherein the period of the reference waveform coincides with a vertical sync signal of the display screen.

3. The monitor according to claim 1, wherein the display screen includes a horizontal scanning frequency signal generator that generates a horizontal scanning signal including a horizontal sync signal and the clock control means produces a clock output signal corresponding to a predetermined multiple of the horizontal scanning frequency, the clock signal having a variable delay with respect to the horizontal sync signal.

4. The monitor according to claim 2, wherein the clock signal has a variable delay both before the horizontal sync signal and after the horizontal sync signal.

5. The monitor according to claim 1, wherein the display screen includes a horizontal scanning frequency signal generator that generates a horizontal scanning signal including a horizontal sync signal and the clock control means produces clock signal pulses at a frequency corresponding to a predetermined multiple of the horizontal scanning frequency, and the periods between clock signal pulses are dynamically adjustable.

6. The monitor according to claim 1, wherein the periods between clock pulses at the beginning of a horizontal display line on the display screen are longer than the periods between the clock pulses at the end of the horizontal display line on the display screen.

7. The monitor according to claim 1, wherein the periods between clock pulses in the middle of a horizontal display line on the display screen are shorter than the periods between the clock pulses at the beginning and end of the horizontal display line on the display screen.

8. The monitor according to claim 1, wherein the display screen is a cathode ray tube (CRT).

9. The monitor according to claim 8, wherein the clock signal has a variable delay both before the horizontal sync signal and after the horizontal sync signal.

10. The monitor according to claim 1, wherein the reference waveform is at least one of a pincushion distortion wave, keystone distortion wave, H linearity wave, and H linearity balance wave.

11. The monitor according to claim 1, wherein the output control clock means varies the output clock timing to achieve at least one of size changes, centering, pincushion, pincushion balance, keystone, keystone balance, tilt, vertical linearity, vertical linearity balance, vertical pin cushion, vertical pincushion balance, vertical keystone, vertical keystone balance, contrast, brightness, corner brightness, gamma, and convergence on the display data displayed on the display screen.

12. The monitor according to claim 1, wherein the output control clock means varies the output control clock to achieve at least one of zoom, image flip, and image rotation on the display data displayed on the display screen.

13. An apparatus for providing display data to a monitor comprising:

a frame memory for storing one or more frames of display data for display on a display screen;

an output clock configured to provide timing for reading display data from the frame memory; and an output clock control means for varying the timing of the output clock according to a reference waveform applied to the output clock, wherein the varying the timing of the output clock comprises the steps of:

(a) generating output clock pulses for reading display data out of the frame memory, the timing and frequency of the output clock pulses being a function of two separate input signals;

(b) frequency dividing the output clock pulses and producing an output horizontal sync pulse every predetermined number of clock pulses;

(c) phase comparing both an input horizontal clock signal from an external source that also supplies the display data to the frame memory and the output horizontal sync pulse to produce a phase error signal representing the difference in phase between the output horizontal sync pulse and the horizontal clock signal and supplying the phase error signal as a first one of the two separate input signals for step (a); and applying a reference signal as a second one of the two separate input signals for step (a) for varying the period and timing of the clock pulses as a function of the waveform of the reference signal.

14. A method for manipulating an image displayed on a monitor comprising the steps of:

storing at least one frame of display data in a frame memory;

displaying an image on a display screen by reading and displaying the display data at a rate of an output clock;

varying the timing of the output clock according a reference waveform, wherein the varying the timing at which the display data are read out from the frame memory to the display screen comprises the steps of:

(a) generating output clock pulses for reading display data out of the frame memory, the timing and frequency of the output clock pulses being a function of two separate input signals;

(b) frequency dividing the output clock pulses and producing an output horizontal sync pulse every predetermined number of clock pulses;

(c) phase comparing both an input horizontal clock signal from an external source that also supplies the display data to the frame memory and the output horizontal sync pulse to produce a phase error signal representing the difference in phase between the output horizontal sync pulse and the horizontal clock signal and supplying the phase error signal as a first one of the two separate input signals for step (a); and applying a reference signal as a second one of the two separate input signals for step (a) for varying the period and timing of the clock pulses as a function of the waveform of the reference signal.

15. The method according to claim 14, wherein the reference waveform varies the output clock in a manner that manipulates the image displayed on the display screen.

16. A method for manipulating an image displayed on a monitor according to claim 14, further comprising the steps of generating a horizontal scanning signal including a horizontal sync signal and producing a clock signal corresponding to a predetermined multiple of the horizontal scanning frequency, the clock signal having a variable delay with respect to the horizontal sync signal.

17. A method for manipulating an image displayed on a monitor according to claim 14, further comprising the step of generating a horizontal scanning signal including a horizontal sync signal and producing clock signal pulses at a frequency corresponding to a predetermined multiple of the horizontal scanning frequency, and dynamically adjusting the periods between clock signal pulses.

18. A method for manipulating an image displayed on a monitor according to claim 17, wherein the periods between clock pulses at the beginning of a horizontal display line on the display screen are longer than the periods between the clock pulses at the end of the horizontal display line on the display screen.

19. A method for manipulating an image displayed on a monitor according to claim 17, wherein the periods between clock pulses in the middle of a horizontal display line on the display screen are shorter than the periods between the clock pulses at the beginning and end of the horizontal display line on the display screen.

20. A method for manipulating an image displayed on a monitor according to claim 14, further comprising the step of generating a reference signal as a second one of the two separate input signals for step (a) for varying the period and timing of the clock pulses as a function of the waveform of the reference signal.

21. A method for manipulating an image displayed on a monitor according to claim 14, wherein the step of displaying an image on a display screen includes displaying an image on a cathode ray tube (CRT) display screen.

22. A method for manipulating an image displayed on a monitor according to claim 14, wherein the reference waveform is at least one of a pincushion distortion wave, keystone distortion wave, H linearity wave, and H linearity balance wave.

23. A method for manipulating an image displayed on a monitor according to claim 14, further comprising the step of varying the timing of the output clock to achieve at least one of size changes, centering, pincushion, pincushion balance, keystone, keystone balance, tilt, vertical linearity, vertical linearity balance, vertical pin cushion, vertical pincushion balance, vertical keystone, vertical keystone balance, contrast, brightness, corner brightness, gamma, and convergence on the display data displayed on the display screen.

24. A method for manipulating an image displayed on a monitor according to claim 14, further comprising the step of varying the timing of the output clock to achieve at least one of zoom, image flip, and image rotation on the display data displayed on the display screen.

* * * * *